United States Patent [19]

O'Neil et al.

[11] 4,192,127

[45] Mar. 11, 1980

[54] METHOD AND APPARATUS FOR MAKING MONOFILAMENT TWINES

[75] Inventors: John B. O'Neil, Summerville, S.C.; William Dewhirst, Philadelphia, Pa.

[73] Assignee: Exxon Research & Engineering Co., Florham Park, N.J.

[21] Appl. No.: 946,889

[22] Filed: Sep. 28, 1978

[51] Int. Cl.² ..... D02G 3/38; D02G 3/40

[52] U.S. Cl. ..... 57/7; 57/228; 57/286

[58] Field of Search ..... 57/7, 12, 210, 216, 57/220, 222, 234, 332, 225-228, 286, 292, 295-297; 156/148, 167, 180; 264/103, 167, 174

[56] References Cited

U.S. PATENT DOCUMENTS

| | | | |
|---|---|---|---|
| 2,281,647 | 5/1942 | Whitehead | 57/234 X |
| 2,463,619 | 3/1949 | Kunzle | 57/332 |
| 2,953,418 | 9/1960 | Runton et al. | 57/234 X |
| 3,415,919 | 12/1968 | Kippan | 264/167 |
| 3,446,002 | 5/1969 | Kippan | 57/234 |
| 3,593,509 | 7/1971 | Feese et al. | 57/332 X |
| 3,609,953 | 10/1971 | Kitawaza | 57/226 |
| 3,769,787 | 11/1973 | Rosenstein et al. | 57/227 |
| 4,095,403 | 6/1978 | Beraud et al. | 57/234 X |

*Primary Examiner*—Donald Watkins

*Attorney, Agent, or Firm*—M. B. Kurtzman; J. J. Mahon

[57] ABSTRACT

A method of producing twine composed of a plurality of thermoplastic mono filaments in a bundle which comprises, passing a bundle of thermoplastic monofilaments continuously along a path, imparting a false twist of 3 to 30 turns per linear foot to said bundle, applying a compatible molten thermoplastic spiral band to said twisted bundle as a spiral band to fuse said spiral band to the outer monofilaments, and recovering a twine having a portion of said false twist captured therein by fusion of the spiral band thereon.

The apparatus for obtaining this twine consists of a path along which a bundle of thermoplastic synthetic monofilaments having a false twist therein can be continuously moved, means to direct a molten compatible thermoplastic on to said twisted bundle to form one or more spiral bands on said bundle and to fuse the outer monofilaments of the bundle to the spiral band, and means for imparting a false twist to said bundle at a point prior to said directing means.

By this process and apparatus, some of the false twist may be captured by the fusion of the spiral band on to the twisted monofilament bundle, producing a better overall twine for use in automatic hay balers compared to twine made without twisting.

11 Claims, 7 Drawing Figures

METHOD AND APPARATUS FOR MAKING MONOFILAMENT TWINES

BACKGROUND OF THE INVENTION

1. Field of the Invention

The present invention relates to a method and apparatus for producing twine from thermoplastic materials. More particularly, the twine is made from a bundle of oriented thermoplastic monofilaments which is bound by a thermoplastic material, which extends around the bundle in a spiral form.

2. Prior Art

U.S. Pat. No. 3,415,919 to Kippan discloses a method of producing a twine by extruding a thermoplastic material in a spiral on to a untwisted bundle of oriented thermoplastic monofilaments. According to Kippan prior art fiber twine of necessity is twisted in order to transmit stress from one fiber to another and develop the continuity of tensile strength of the cord. The patentee notes that monofilament twine prior to his development was twisted so that the monofilaments contained themselves by intertwined helixes to form a unit twine or cord.

Kippan notes several disadvantages of twisted twine. The primary disadvantage is a weaker twine, since the helixes are able to assume only a portion of an applied tensile load, whereas in a parallel alignment of monofilaments each filament is able to fully bear an applied tensile load. In theory, at least the tensile strength of a twine having all of the monofilaments aligned is the sum of the tensile strengths of each filament (in practice tensile strength is slightly less).

Another disadvantage of the twisted cord according to Kippan is that it tends to untwist when it is slack, forming snarls which can cause problems in mechanical hay balers.

Other prior art of interest in U.S. Pat. Nos. 3,446,002 to Kippan (monofilament twine), 3,769,787 to Rosenstein (yarn composed of twisted or untwisted core of filaments is wrapped helically, both clockwise and counter clockwise), 3,577,873 and 3,851,457 to Waters (a yarn composed of a set false twist and reversing helical binding).

It has been found that twine or cord such as described by Kippan having parallel monofilaments bound by an extruded binder, also is disadvantageous in mechanical balers. The straight monofilaments can be deformed in the knotting operations such that individual fibers break out between the spiral binding. The structure becomes less homogeneous in the knotting step and a protruding monofilament may catch in the mechanism.

SUMMARY OF THE INVENTION

Briefly, the method of making twine according to the present invention comprises continuously drawing a bundle of substantially parallel synthetic monofilaments along a path, imparting a false twist to said bundle of monofilaments, and directing a stream of molten synthetic material, which is compatible with the monofilament material, onto the outer surface of said moving, twisted monofilament bundle to form a spiral band therearound.

The molten material is directed on to the surface of the bundle at a temperature and pressure sufficient to cause the band which is formed to fuse to the contacted monofilaments, but without materially affecting the strength of the fused monofilaments. The monofilaments on the inside of the bundle are free to move relative to each other.

As noted above, the use of a twist in synthetic monofilament twine is not new. The twist is a part of the structure. A "false twist" as that term is generally understood and used herein is a twist which is applied to a filament or bundle of filaments by a torque applied thereto, which will reverse and return to the zero twist upon release of the torque.

A "set false twist" such as employed in U.S. Pat. Nos. 3,577,873 and 3,851,457 for the production of yarn would indicate the twist has been made a part of the structure of the filament. In the case of thermoplastic monofilaments, the twist is set for example, by heat treatment of the monofilament in the twisted configuration. Thus, it may be said a set false twist has become a true twist.

This is an important distinction of the present invention over the prior art. It has been found that imparting a false twist to a bundle of thermoplastic monofilaments prior to extruding a band or binder onto the bundle, produces a novel twine having improved knotting properties in automatic baling machines. By employing a false twist, a single continuous process is obtained. It would appear that contact of the molten binder strip with the outer monofilaments entraps some portion of the false twist, however, unlike a "set false twist", detachment of the binder will alow the monofilaments to return to the zero twist state. The binder strip may be extruded conventionally such as shown in U.S. Pat. No. 3,415,919.

The apparatus comprises a path along which a bundle of substantially parallel synthetic monofilaments having a false twist therein can be continuously drawn, means for directing a continuous stream of molten synthetic material which is compatible with said monofilament material, on to the other monofilaments of the twisted moving bundle, thereby forming a spiral band therearound, means for supplying said molten synthetic material to said directing means at a temperature and pressure sufficient to cause the formed spiral band to fuse with said outer monofilaments without materially affecting the strength of said outer monofilaments, whereby the other monofilaments of said bundle are left free to move relative to each other, and a false twisting means for imparting a false twist to said bundle of monofilaments at a point prior to said directing means whereby said bundle is characterized as having a false twist therein along said path.

The term twine as used herein is understood to include twine, cord, yarn and the like.

The present apparatus and process are particularly suited for the use of preferred synthetic thermoplastic materials, such as polyethylene, polypropylene and their copolymers. Various other synthetic materials which may be employed include polyamides, e.g., poly(hexamethylene adipamide), polyesters, such as polymers of terephthalic acid or isophthalic acid and a lower glycol, e.g., poly(ethylene-terephthalate), poly(-hexahydro-p-xylene terephthate); polyalkylene generally, e.g., polyethylene; polyvinyls, e.g., polyvinyl chloride; polyacrylics, e.g., poly-acrylonitrile and the copolymers of acrylonitrile with other comonomers and other synthetic continuous filament materials, regardless of denier per filament and regardless of the cross-section or total denier of the product.

The filaments may have a wide variety of cross-sections in addition to the usual circular cross-section, such as, eliplical, Y-shaped, triangular, heart-shaped, square and the like.

Generally, the twine will have a denier in the range of 5000 to 50,000 more preferably 25,000 to 35,000 with each monofilament falling generally in the range of 50 to 500 denier.

The false twist will generally be applied at a rate of 3 to 30 turns per linear foot of monofilament, preferably about 5 to 15 turns per linear foot. The spirals will be applied generally at the rate of 8 to 30 per linear foot. The monofilament bundle will generally be drawn through the apparatus at 200 to 2000 feet per minute, preferably about 500 to 1500 feet per minute.

DETAILED DESCRIPTION OF A PREFERRED EMBODIMENT

Figure 1:
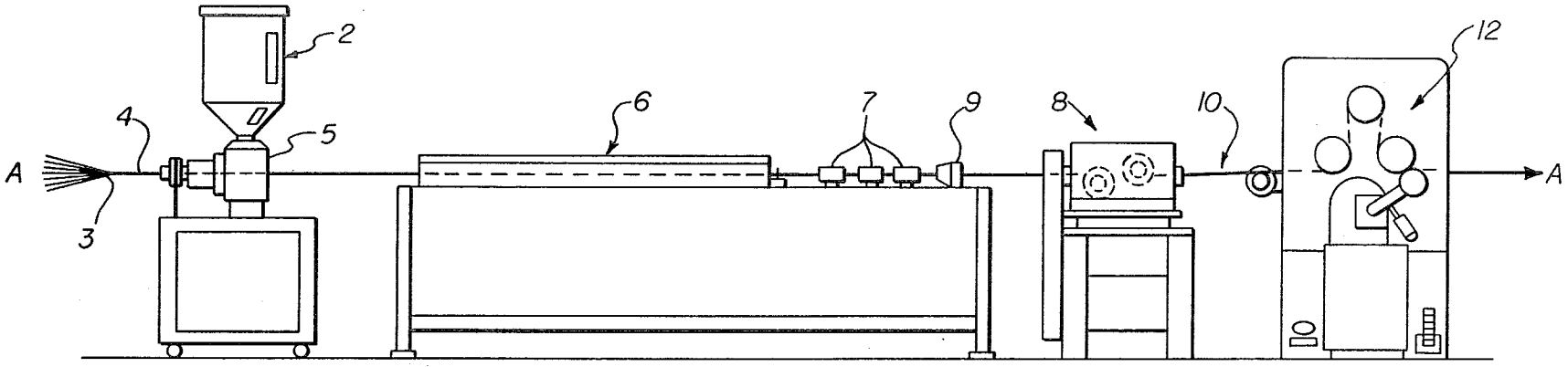
FIG. 1 is a schematic representation of one form of apparatus according to the present invention.

FIG. 1 shows a process line according to the present invention. A plurality of thermoplastic monofilaments 4 are conveyed along a path, the axis A—A, through a die assembly 5 attached to an extruder 2, hence through cooler tank 6 through false twisting means 8 and into drawing apparatus 12 through whish the completed twine 10 is passed to the take up apparatus (not shown). The principal difference in this apparatus and that which would ordinarily be found in facilities making monofilament twine according to the prior art is the twister 8.

Briefly, the thermoplastic monofilament is conventionally extruded by means well known in the art and which forms no part of this invention. Preferably the filaments are oriented along the axis of the twine in the well known manner of the prior art. Hence, in the present invention, as in the prior art, the monofilaments 4 are preferably made of a bundle of substantially parallel, oriented theremoplastic monofilaments wherein the difference is, the present bundle 4 is twisted at a point 3 prior to entry into die assembly 5, so that a bundle having 3 to 30 turns per linear foot passes into die assembly 5 wherein a continuous spiral band 18 of a compatible thermoplastic material is applied to the twisted bundle of monofilaments 4.

The spiral band is comprised of a material which is compatible with the monofilament material and is applied at a temperature and pressure, so as to fuse the band to only the outer layer of monofilaments.

The twisted and banded monofilament preferably passes through a conventional cooling section, such as that shown having a water quench 6, drying sponges 7 and air drying means 9, which is employed to solidily the extruded sprial band 18. The cooling of band 18 which is fused to the outer monofilaments serves to entrap some of the false twist or the characteristics of the twisted monofilament bundle.

The twists or turns in the monofilament bundle 4 are obtained by having a false twisting means 8 down stream of the extruder 2. The twist is obtained by the false twister grasping the banded monofilament bundle 4, as for example with the arrangement, shown in FIG. 6, and continuously rotating the grasping portion of the false twister 360° around an axis parallel to the axis A—A of the monofilament bundle 4, thereby extending the twist upstream along the bundle 4, through the cooler 6, through the die assembly 5 and back to point 3 upstream of the extruder 2. As the twine 4 passes out of false twister 8, the twisted monofilaments are freed of the torque from the false twister and would normally return to their untwisted, longitudinal state, which is also their tendency here, but for the band 18 which is fused to the outer monofilaments.

Figure 2:
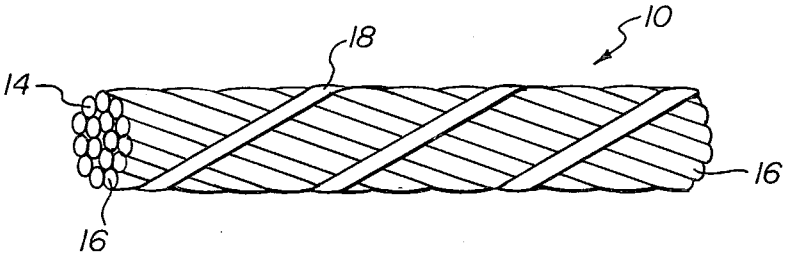
FIG. 2 is an enlarged view of a piece of twine made according to the present invention.

Referring to FIG. 2, a segment of twine 10 produced according to the present invention is illustrated. The monofilaments 14 (inner) and 16 (outer) are shown to have a Z twist. The Z twist being a counter clockwise twist. the spiral band 18 (in this embodiment) has an S twist, which is clockwise. As noted above, since a false twist was applied, the twist would normally not present in the twine, unless it were heat treated to set the twist in the monofilament. However, the spiral band or binder 18 is fused to the twisted outer monofilaments, thereby capturing at least some of the twist in the final product 10. There is a slight torque thus captured in the monofilaments which are seeking to return to their static or dead untorqued state.

It should be appreciated that the spiral band 18 could have the same twist configuration as the monofilaments, and it would also capture some torque in the monofilaments in the same fashion, since the spiral band 18, is itself in the static or dead state and will resist the movement of the torqued monofilaments, to which it is bound. Similarly, either the monofilament bundle or the binder may be S or Z when different configurations are desired. When the monofilament bundle and binder have the same twist configuration, i.e., both S or both Z twist, the product has been found to be a very flat band of monofilaments with the binder therearound.

Although the spiral band or binder 18 is illustrated as a single band, it should be appreciated two or more bands may be used and in fact normally two bands would be employed.

Figure 3:
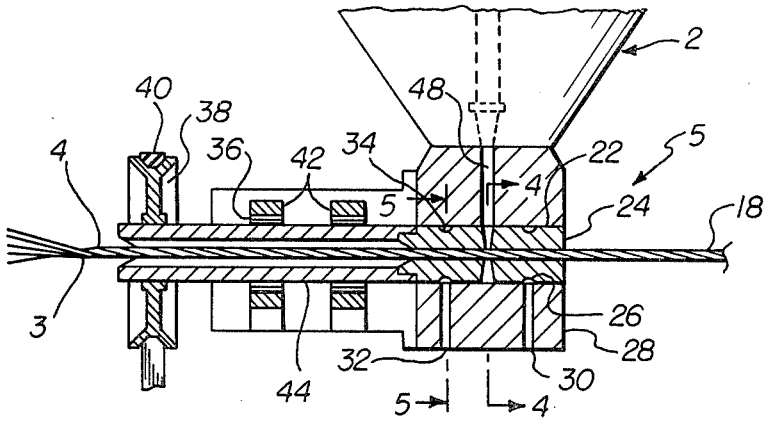
FIG. 3 is an enlarged partial cross sectional elevation of extruder and crosshead die 2 of FIG. 1.
Figure 4:
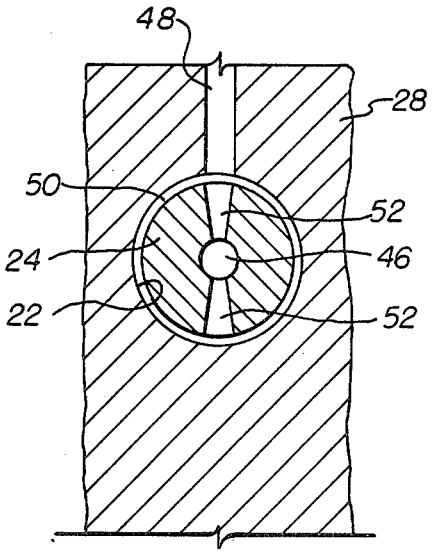
FIG. 4 is a cross section taken on the line, 4—4 of FIG. 3.
Figure 5:
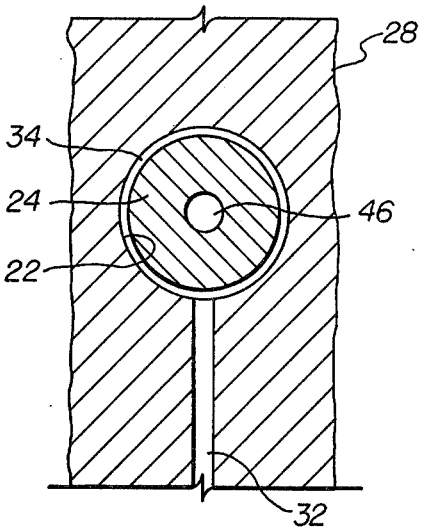
FIG. 5 is a cross section taken on the line 5—5 of FIG. 3.
Figure 7:
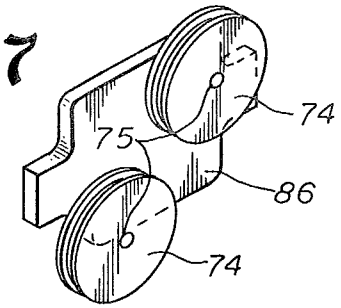
FIG. 7 is a perspective view of the twine twisting element shown in FIG. 6.

FIGS. 3–5 illustrate the die assembly 5 and show the relationship of the monofilament bundle 4 and the twist beginning at point 3 prior to the die assembly 5. The die assembly 5 includes a crosshead 28 having a die passage 22 extending therethrough. An elongated die 24 is rotatably mounted in and extends through passage 22. This die has an axial bore 46 extending therethrough which is just large enough to accommodate a moving monofilament bundle 4 which has been previously formed by conventional means not shown and which are twisted in a counter clockwise direction and which are drawn through the bore in any suitable manner, such as by the drawing apparatus 12 (which must be located down stream of the twister 8).

Die 24 is rotated around the longitudinal axis thereof in any suitable manner. For example, a pulley 38 may be mounted on an elongated tubular drive shaft 44 rotatably mounted in bearing 36 of a plurality of support blocks 42. Pulley 38 is rotated by a drive belt 40 which, in turn, extends to an appropriate motor means (not shown).

Suitable means is provided for directing one or more streams of molten synthetic material through rotating die 24 into bore 46 thereof and onto the outer surface of bundle 4, as the latter moves linearly through said bore. An annular groove 50 is formed in the outer surface of die 24, and one or more passages 52, extend from said groove 50 inwardly and open into bore 46. These passages or nozzles are preferably tapered inwardly from the groove towards the bore.

The molten synthetic material is directed into annular groove 50 through passage 48 extending through crosshead 28. The molten material is fed to passage 48 by a standard plastic extruder 2.

Since there is sufficient clearance in passage 22 to permit die 28 to rotate, there is a tendency for the molten thermoplastic to flow axially along the outer surface of the die. In order to avoid seizing of the die by this material, annular grooves 26 and 34 are provided in the outer surface of die 24 on opposite sides of groove 50. Passages 30 and 32 in crosshead 28 communicate with grooves 26 and 34, respectively and extend downward therefrom, and may be connected by pipes to extend away from the apparatus.

Figure 6:
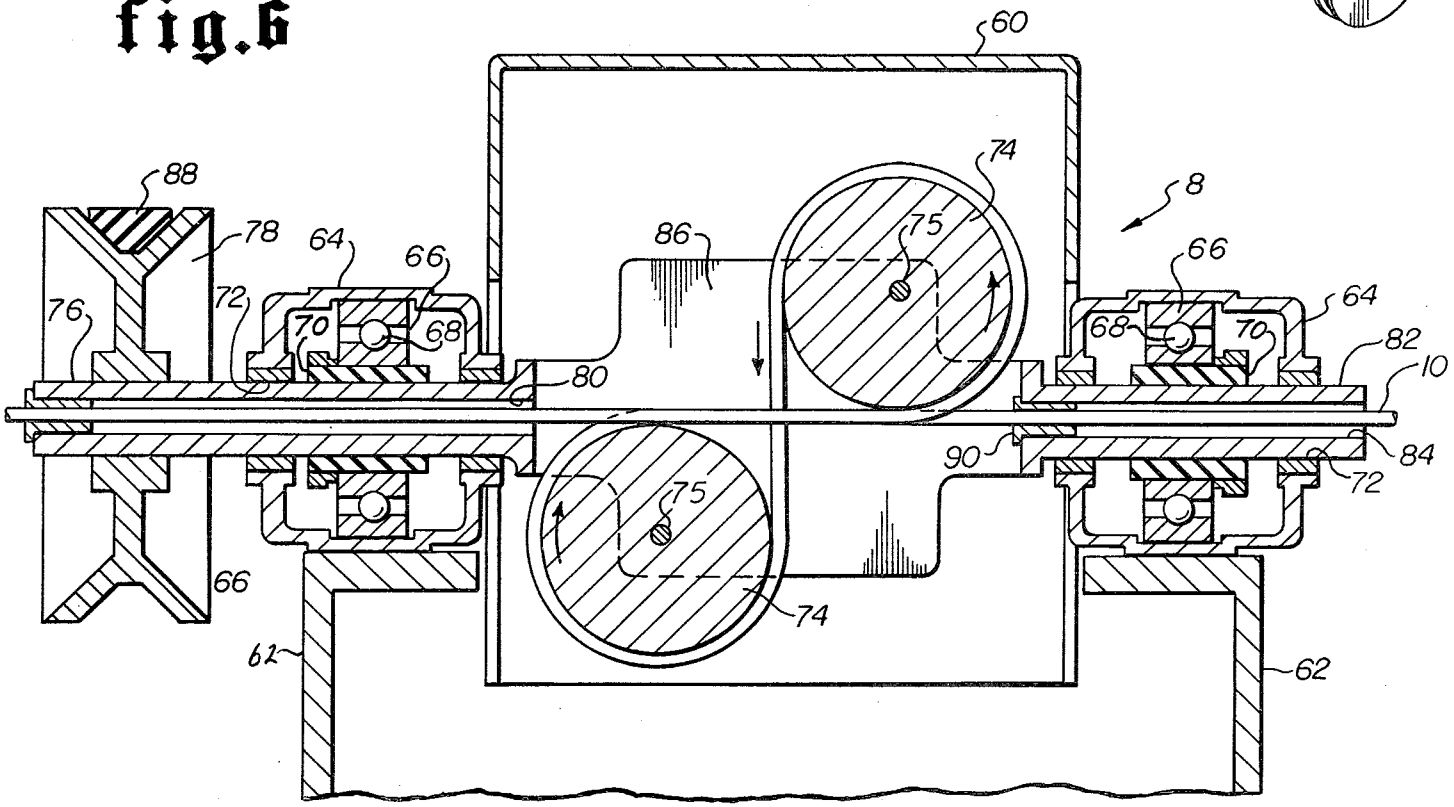
FIG. 6 is an enlarged partial cross sectional elevation of the twister 8 of FIG. 1.

The false twisting means 8 as shown in FIG. 6, consist of housing 60 affixed to a support 62 by support members 64. Each support member 64 is attached to the support 62 and housing 60 on opposite sides of the housing. Each support member 64 has a bore 72 therethrough, a support bearing 66 and a biased bearing 70, both of said bores 72 being aligned with each other.

A rotatably mounted shaft 76 having a bore 80 therethrough and a pulley 78 mounted thereon extends through the bore 72 of one support member into housing 60. A second rotatably mounted shaft 82 having a bore 84 therethrough extends through the bore 72 of the other support member 64 into housing 60, the bores 80 and 84 being aligned. Mounted between the two shafts 76 and 82 is plate 86. Rotatably mounted to said plates are two sheaves or rollers 74. The rollers 74 are mounted diagonally on opposite sides of the axis of the bores 80 and 84, by means of pins 75, so that rollers 75 are free to rotate. The bearings 70 are biased by means 68 against shafts 76 and 82 respectively. Pulley 78 is rotated by a drive belt 88, which in turn is connected to an appropriate motor (not shown).

In operation the bundle 4 which has had the spiral band 18 applied in the crosshead 5 enters the housing 60 through the bore 80 of shaft 76, passes around one roller 74 then around the other roller 74 and hence out of the housing through bore 84 of shaft 82. A slight tension on the twine 10 by the drawing apparatus 12, allows the twine 10 to be gripped in this manner so that as the shaft 76 is rotated the entire assembly comprised of the two shafts 76 and 82, the attached plate 86 and the rollers 74 mounted thereon, rotates about the longitudinal axis A—A of the twine thereby twisting the twine 10. Bushing 90 tightly abuts the twine thereby forcing the twisting to extend upstream to point 3 on the bundle 4. This is only one means of twisting the monofilament bundle and any means which will achieve this function may be employed.

In operation there may be more than one monofilament bundle on a sheave, for example, two or three independent bundles may be on one sheave provided the sheaves or rollers 74 are wide enough. The twist is extended down each bundle and the bundles may be twisted about one another, however, this has no adverse effect. The individual product twines separate as they leave the twister 8 and are taken up separately. This allows for an economy of equipment, since only one cooling section and twister are required for the preparation of a plurality of twines.

During operation of the die assembly 5, die 24 is rotated at a desired speed. The monofilament bundle 4 is continuously drawn through the bore of the die by the drawing apparatus 12 and twisted by twisting means 8 such that a bundle of monofilaments having a desired number of turns per foot is passed into the die. The compatible synthetic material is directed to the extruder 2 through passage 48 and annular passage 50 into radial passages or nozzles 52 in the rotating die. The two passages form two spiral bands on the twisted bundle 4.

The compatible molten material is at a temperature and pressure to fuse to the outer monofilaments it contacts. Any molten material moving along bore 22 over the outer surface of die 24 drains off through low pressure passages 30 and 32.

The temperature of the molten thermoplastic extruded onto the twisted monofilament bundle must be adjusted to prevent damage or degradation of the monofilaments, which those operating the process need to routinely determine for the materials employed. Similarly, the adjustment of the rate of speed at which the monofilament bundle is drawn along its path, the rate of twist in relation thereto and the rate of spiral band application are all adjustable as desired or required for any particular thermoplastics employed.

It is readily apparent that other specific crosshead die assemblies and twisting means may be employed with the same function and result as those illustrated.

Thus, the present invention provides a means to produce a twine which has some loss of tensile strength but which has better characteristics for use with automatic hay bailing machinery, especially in tying the knot and knot strength, then prior art twine made without the false twist.

The invention claimed is:

1. A method of making twine comprising continuously drawing a bundle of substantially parallel synthetic monofilaments along a path at a rate in the range of 200 to 2000 feet per minute, imparting a false twist to said bundle of monofilaments at a rate of about 3 to 30 turns per linear foot and directing a stream of molten synthetic material onto the outer surface of said moving, twisted monofilament bundle to form a spiral band therearound, the molten material being directed onto the surface of said bundle at a temperature and pressure sufficient to cause the band which is formed to fuse to the contacted monofilaments without materially affecting the strength of the fused monofilaments.

2. The method according to claim 1 wherein the monofilaments on the inside of said bundle are free to move relative to each other.

3. The method according to claim 1 wherein said synthetic materials are thermoplastic.

4. The method according to claim 3 wherein said thermoplastic is polypropylene.

5. An apparatus for producing twine from a bundle of synthetic monofilament, comprising:

a path along which a bundle of substantially parallel synthetic monofilaments having a false twist therein can be continuously drawn, means for directing a continuous stream of molten synthetic material, which is compatible with said monofilament material, on to the outer monofilaments of the twisted moving bundle, thereby forming a spiral band therearound, means for supplying said molten synthetic material to said directing means at a temperature and pressure sufficient to cause the formed spiral band to fuse with the said outer monofilaments without materially affecting the strength of said outer monofilaments of said bundle, whereby the other monofilaments of said bundle are left free to move relative to each other, and a false twisting means for imparting a false twist to said bundle of monofilaments at a point prior to said directing means, whereby said bundle of monofilaments is characterized as having a false twist therein along said path.

6. The apparatus according to claim 5 wherein false twisting means is located downstream of said directing means along said path.

7. The apparatus according to claim 6 wherein said false twisting means comprises means for grasping said bundle of monofilaments having a spiral band therearound and rotating said bundle about a longitudinal axis, whereby said bundle of monofilaments is twisted along said path to a point on said path, prior to said directing means.

8. The apparatus according to claim 7 comprising a rotatably mounted frame mounted in said path, at least one rotatably mounted sheave mounted tangentially to said path, for passing said banded bundle of monofilaments around said sheave thereby securing said banded bundle such that rotation of said frame causes said banded bundle to twist.

9. The apparatus according to claim 8 wherein a pair of rotatably mounted sheaves are diagonally mounted in said frame tangential to said path whereby said banded bundle passes around both seahves.

10. The apparatus according to claim 7 wherein said directing means comprises at least one nozzle directed toward said path and capable of moving circumferentially about said path.

11. The apparatus according to claim 8 wherein a plurality of banded bundles pass around said sheave.

* * * * *